US011623800B2

(12) United States Patent
Buck et al.

(10) Patent No.: US 11,623,800 B2
(45) Date of Patent: Apr. 11, 2023

(54) CHILD RESISTANT CAN TOP

(71) Applicants: Jeremiah J. Buck, Wheat Ridge, CO (US); Venita Nelson, Wheat Ridge, CO (US); Tim Hanley, Wheat Ridge, CO (US); Zachariah Johnson, Wheat Ridge, CO (US); Jeremy Cooper, Wheat Ridge, CO (US)

(72) Inventors: Jeremiah J. Buck, Wheat Ridge, CO (US); Venita Nelson, Wheat Ridge, CO (US); Tim Hanley, Wheat Ridge, CO (US); Zachariah Johnson, Wheat Ridge, CO (US); Jeremy Cooper, Wheat Ridge, CO (US)

( * ) Notice: Subject to any disclaimer, the term of this patent is extended or adjusted under 35 U.S.C. 154(b) by 0 days.

(21) Appl. No.: 16/729,304

(22) Filed: Dec. 28, 2019

(65) Prior Publication Data

US 2021/0403211 A1 Dec. 30, 2021

(51) Int. Cl.

| | |
|---|---|
| ***B65D 50/06*** | (2006.01) |
| ***B65D 41/46*** | (2006.01) |
| ***B65D 17/28*** | (2006.01) |

(52) U.S. Cl.

CPC ..... *B65D 50/061* (2013.01); *B65D 17/4012* (2018.01); *B65D 41/46* (2013.01); *B65D 2215/04* (2013.01); *B65D 2517/0014* (2013.01); *B65D 2517/0041* (2013.01); *B65D 2517/0062* (2013.01)

(58) Field of Classification Search

CPC .. B65D 50/061; B65D 17/4012; B65D 41/46; B65D 2215/04; B65D 2517/0014; B65D 2517/0041; B65D 2517/0062

USPC ..... 220/254.1, 214, 257.2, 258.2, 258.3

See application file for complete search history.

(56) References Cited

U.S. PATENT DOCUMENTS

| | | | | |
|---|---|---|---|---|
| 6,290,084 | B1 * | 9/2001 | Louie | B65D 17/4012 220/270 |
| 2008/0230544 | A1 * | 9/2008 | Kim | B65D 51/20 220/258.2 |
| 2012/0138621 | A1 * | 6/2012 | Bratsch | B65D 17/4014 220/780 |
| 2016/0355306 | A1 * | 12/2016 | Robin | B65B 3/04 |
| 2020/0262621 | A1 * | 8/2020 | Savenok | B65D 51/20 |
| 2020/0270033 | A1 * | 8/2020 | Sanguinet | B65D 17/4012 |
| 2021/0276760 | A1 * | 9/2021 | Savenok | B65D 51/20 |

* cited by examiner

*Primary Examiner* — J. Gregory Pickett
*Assistant Examiner* — Niki M Eloshway
(74) *Attorney, Agent, or Firm* — Frederic M. Douglas

(57) ABSTRACT

The present invention may comprise a main tab, a tab shield, a rim, an interior rim guard, and a tab finger port. The invention may further comprise breakable connectors among the tab, tab shield, rim, interior rim guard, and other structures, such that breakage of the connectors indicates access to a container after preventing or inhibiting access to a container, such as a beverage can.

13 Claims, 5 Drawing Sheets

CHILD RESISTANT CAN TOP

BACKGROUND OF THE INVENTION

The present invention relates generally to child-resistant container covers. More specifically, the present invention relates to a method and apparatus for preventing child access to a container, such as a beverage can, and providing evidence of tamper or access to the container.

Beverages have been stored, distributed, and sold in various types of containers. For individual use, bottles and cans are ubiquitous. One type of container is an aluminum can in a cylindrical shape, usually with a flip-top opening for manual breaking of a seal and flexing back to clear an opening for pouring and drinking the contents.

In some cases, people do not want containers to be easily opened by children or unauthorized individuals when the containers carry a substance that is harmful, controlled, dangerous, or costly.

Some beverages are subject to legal restrictions, such as most notably, alcoholic beverages. Another type of consumable that is restricted is pharmaceuticals and marijuana-based or hemp-based products. Casual consumption can be dangerous if consumed to excess or without proper administration. A chief concern is limiting access to minors (individuals under the local legal age of majority) to avoid harmful consequences. Also, governments institute laws and regulations mandating child-protective barriers to use by minors of controlled substances, such as *cannabis* and *cannabis* products.

The European Union and the United States maintain regulations as to child-resistant packaging for drugs and other substances. The United States Consumer Product Safety Commission (CPSC) regulated child-resistant packaging based on the Poison Prevention Packaging Act (PPPA). The special packaging requirements under the PPPA are directed towards designing packaging to make it significantly difficult for children under five years old to open the packaging or obtain a toxic or harmful amount of the substance therein within a reasonable amount of time. The requirements also maintain that it should not be difficult for ordinary adults to use the packaging properly. The PPPA requirements do not dictate that the packaging should be designed such that 100 percent of children cannot open the packaging or obtain a toxic or hazardous amount within a reasonable time. The U.S. child-resistant packaging performance specifications are found in the regulation cited as 16 C.F.R. § 1700.15. The U.S. Food & Drug Administration guidance on child-resistant packaging is available at https://www.fda.gov/media/70788/download. In the United States, individual states usually have their own child-resistant packaging regulations and guidance.

Many energy drink beverages are sold in aluminum cans and are popular with youth consumers. Some *cannabis*-based beverages are sold in the same cans or type of container. It is desirable that consumers are not inadvertently consuming *cannabis* beverages in the same manner as energy drinks, sodas, or other soft drinks. To prevent minors from accessing and consuming controlled beverages and to avoid mistaken consumption by people unfamiliar with consumption of *cannabis*-based beverages, an apparatus to limit and control opening such containers would be useful.

Several have tried to create child-resistant can lids. U.S. Patent Application Publication No. 2006/0060578 A1 to John R. Church, et al. discloses a locking container and lid assembly incorporating a resilient polymer container and lid that are closed by a snap-lock engagement of the lid with a groove inside a container opening. However, this document does not disclose a lid fitted for a top of a can or for preventing child access to an opening tab for such a can.

Herein is disclosed a can lid for metal cans that children will find difficult to open but adults, especially senior adults, and disabled adults will be able to open the lid readily and easily.

Thus, it would be advantageous to have a device and a method that prevents minor access for safety and waste control.

As will be seen more fully below, the present invention is substantially different in structure, function, and approach from that of the child-resistant can tops previously disclosed.

SUMMARY OF THE INVENTION

In one aspect of the present invention, a device for covering an opening formed in a first surface of a container, may comprise; a covering member having an upper surface, a lower surface, a rim portion, said lower surface contacting a rim portion of a first surface of the container, wherein the container has a longitudinally extending cylindrical surface and including a rim portion extending along the periphery of the first surface of the container, the lower surface of the covering member having a recess for enclosing said rim of the first surface of the container, wherein the container has a longitudinally extending cylindrical surface and including a rim portion extending along the periphery of the first surface of the container and a pivotal lever inside the periphery of the first surface of the container for opening the container, a tab portion at least partially covering the pivotal lever, the tab portion comprising an opening for lifting the tab portion away from the pivotal lever, a frangible seal securing the tab portion to another portion of the covering member, an interior aperture formed through the covering member, the interior aperture situated between the tab portion and a guide member, the guide member connected to the frangible seal to secure the tab portion within the covering member before lifting the tab portion away from the pivotal lever, a lateral aperture formed from the guide member and a semi-circular stabilizing member, the lateral aperture integral with the covering member, an outer aperture formed between the stabilizing member and the rim portion of the covering member, and a lower aperture through the tab portion.

In another aspect of the present invention a combination of a device for covering an opening formed in a first surface of a can and a can for holding a beverage may comprise; a can, including, a top with a rim, a cylindrical body attached to said top at said rim, an orifice formed through said top, and a pivotal lever for operation by a user to open said orifice, a covering member having an upper surface, a lower surface, a rim portion, said lower surface contacting a rim portion of a first surface of the container, wherein the container has a longitudinally extending cylindrical surface and including a rim portion extending along the periphery of the first surface of the container, the lower surface of the covering member having a recess for enclosing said rim of the first surface of the container, wherein the container has a longitudinally extending cylindrical surface and including a rim portion extending along the periphery of the first surface of the container and a pivotal lever inside the periphery of the first surface of the container for opening the container, a tab portion at least partially covering the pivotal lever, the tab portion comprising an opening for lifting the tab portion away from the pivotal lever, a frangible seal securing the tab portion to another portion of the covering member, an interior aperture formed through the covering member, the interior aperture situated between the tab portion and a guide member, the guide member connected to the frangible seal to secure the tab portion within the covering member before lifting the tab portion away from the pivotal lever, a lateral aperture formed from the guide member and a semi-circular stabilizing member, the lateral aperture integral with the covering member, an outer aperture formed between the stabilizing member and the rim portion of the covering member, and a lower aperture through the tab portion.

These and other aspects, objects, features, and advantages of the present invention are specifically set forth in or will become apparent from, the following detailed description of an exemplary embodiment of the invention when read in conjunction with the accompanying drawings.

DETAILED DESCRIPTION OF THE INVENTION

The following detailed description is of the best currently contemplated modes of carrying out the invention. The description is not to be taken in a limiting sense but is made merely for the purpose of illustrating the general principles of the invention, since the scope of the invention is best defined by the appended claims.

Although the invention is often referred to herein as an apparatus and method for restricting child access to opening metal beverage cans, it is understood that such description is not limiting, such that the technology in this invention may be applied in numerous other products and methods, including but not limited to non-beverage containers, non-metallic containers, and similar structures.

The can lid of the present invention cannot be easily opened in a conventional manner by a child, yet is easily opened by an adult, especially senior adults or disabled adults. Another advantage is that the outer edge of the can lid is tapered inwards radially and smooth such that the can lid is not easy to grip off or pry off without opening the lid and breaking the seal composed of frangible elements. The tapered, smooth outer edges of the can lid make the lid difficult to grasp when applied to the top of the can and a sealing ledge on the lid reverse side facing inside grabs a seam roll on the upper edge of the can.

Figure 1:
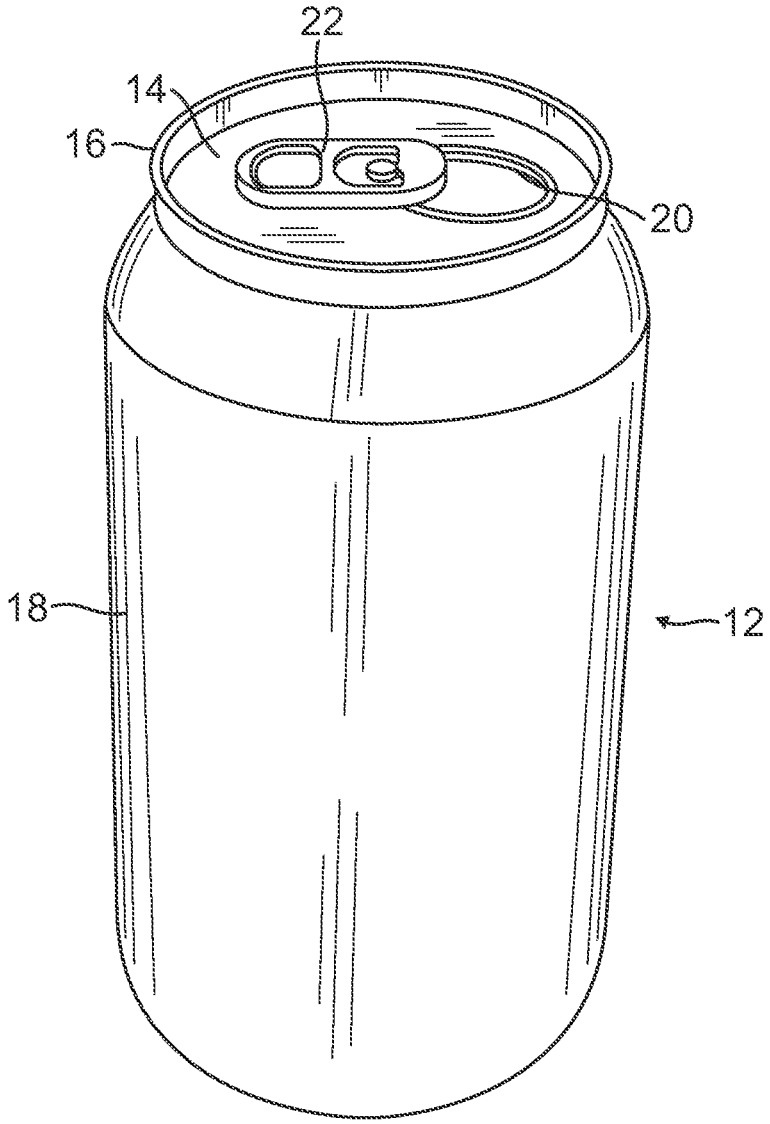
FIG. 1 shows a perspective view of a beverage can, according to an embodiment of the present invention.

In FIG. 1, a beverage container, depicted as a can 12 is a typical beverage container known in the art. The can 12 has a top 14, a rim 16, and a cylindrical body 18 attached to the first surface (top) 14 at the rim 16. A drinking opening 20 is formed in the top 14, opened by a pivotal lever 22. The container 12 has a longitudinally extending cylindrical surface 18 and including a rim portion 16 extending along the periphery of the first surface 14 of the can 12.

The pivotal lever 22 is situated inside the periphery of the first surface 14 of the can 12 for opening the container. The pivotal lever 22 may be operated by most people, including children, to open the can 12 and consume the contents of the can 12.

The covering member may be manufactured of injection-molded plastic, such as polypropylene.

Figure 2:
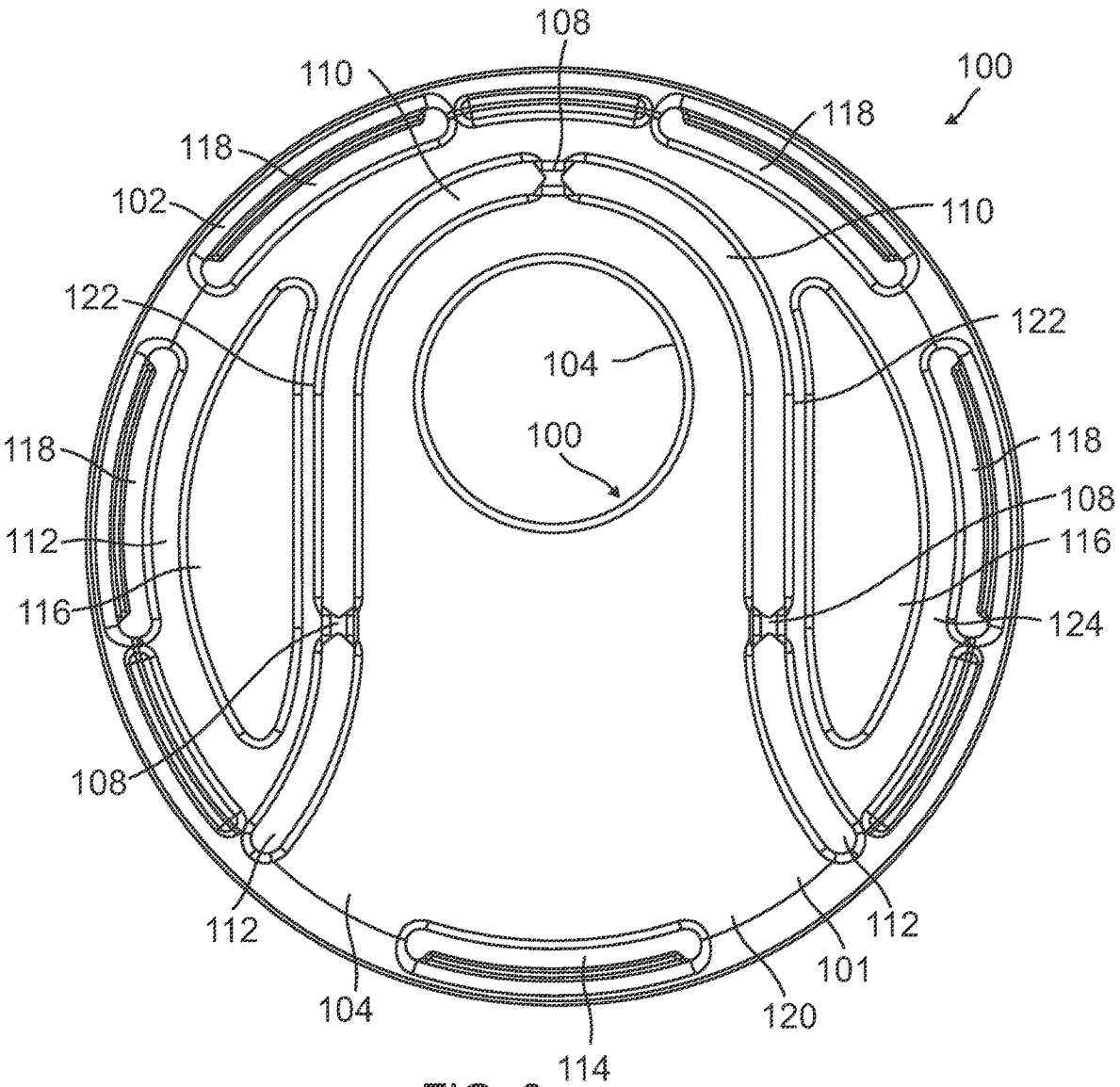
FIG. 2 shows an elevation view of a covering member, according to an embodiment of the present invention.

In FIG. 2 a covering member 100 is shown, with an upper surface 101, a lower surface 103 (shown in FIG. 3), and a rim portion 102, said lower surface 103 contacting a rim portion 16 of a first surface 14 of the container 12.

A tab portion 104 is configured to at least partially cover the pivotal lever 22 (shown in FIG. 1), the tab portion 104 comprising an opening 106 for lifting the tab portion 104 away from the pivotal lever 22 (shown in FIG. 1) and away from the first surface 14 of the can 12 (shown in FIG. 1).

The covering member 100 may be an integral structure. A frangible seal/connector 108, or even a plurality of seals/connectors 108, may be situated to secure or hold in a securing position the tab portion 104 to another portion of the covering member 100, such as a guide member 122;

An interior aperture 110 may be formed through the covering member 100, the interior aperture 110 may be situated between the tab portion 104 and the guide member 122. A lower tab aperture 112 may be formed through the covering member 100, situated between the tab portion 104 and the guide member 122. The lower tab aperture 112 may be bounded by the breakable seal/connector 108.

The guide members 122, here in FIG. 2 shown as two guide members, may be connected to the frangible seal/connector 108 to secure the tab portion 104 within the covering member 100 before lifting the tab portion 104 away from the pivotal lever 22;

A lateral aperture 116 formed from the guide member 122 and a semi-circular stabilizing member 124, the lateral aperture 116 may be integral with the covering member 100.

An outer aperture 118 may be formed between the stabilizing member 124 and the rim portion 102 of the covering member 100. In FIG. 2, the covering member 100 is depicted with four outer apertures 118. The covering member 100 may benefit from a lower aperture 114 through the tab portion 104. The tab portion 104 may comprise a tab portion base 120 for providing substantial structure, a flexing surface, and a location for identifying markings, such as a serial number, trademark, artwork, or other items.

Figure 3:
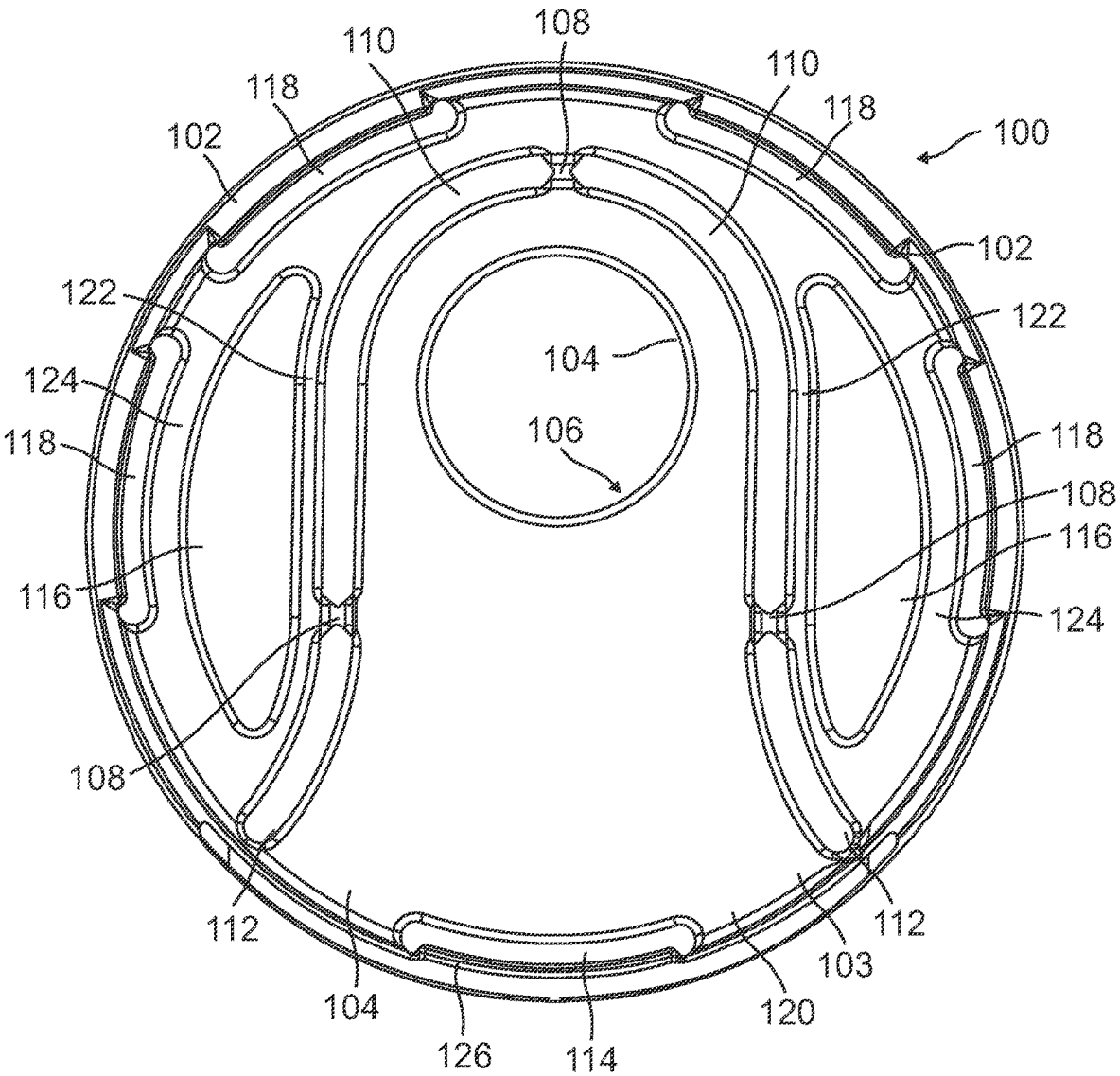
FIG. 3 shows the reverse side of the covering member shown in FIG. 2, according to an embodiment of the present invention.

FIG. 3 the covering member 100 of FIG. 2 from the opposite side. FIG. 3 depicts the lower surface 103 of the covering member 100 having a recess 102 for enclosing said rim 16 of the first surface 14 of the can 12, as shown in FIG. 1.

Figure 4:
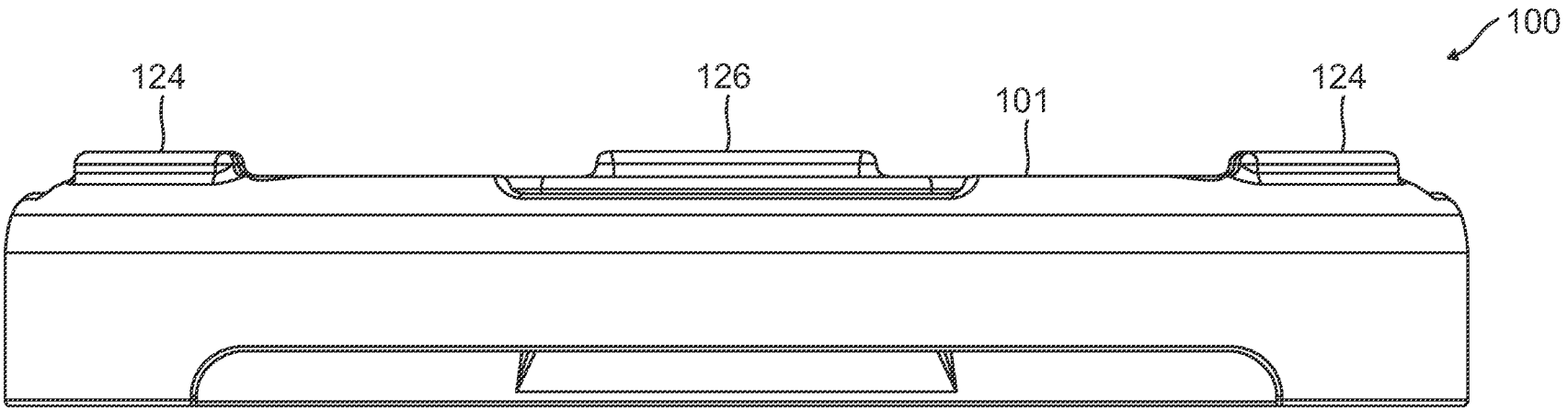
FIG. 4 shows a side view of a covering member, according to an embodiment of the present invention.
Figure 5:
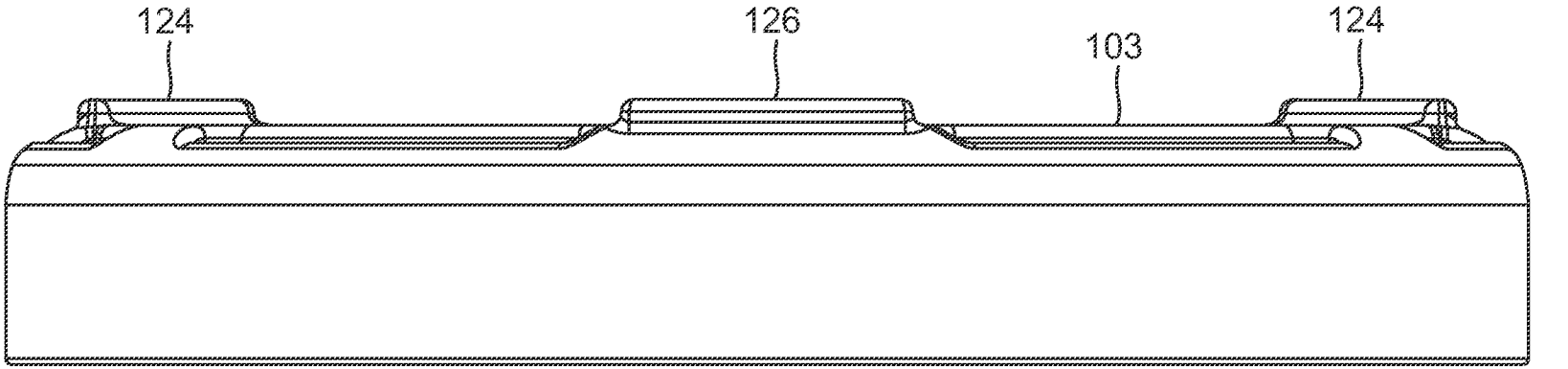
FIG. 5 shows a side view of the covering member in FIG. 4, rotated about 180 degrees, according to an embodiment of the present invention.

FIG. 4 shows an anterior view of the covering member 100 depicting useful arrangements of the structural features, such as semi-circular stabilizing member 124 and retaining tab 126. These features assist in "snapping" the covering member 100 to a can and permitting the covering member 100 to retain securely engagement with the top 14 and/or rim 16 of the can 12 (shown in FIG. 1 and FIG. 6). FIG. 5 shows another, opposite view of the covering member, depicting exemplary structural aspects for securing the covering member 100 to the can 12. Protrusions, like the stabilizing member 124 and the retaining tab 126, may serve to protect a covering member and can when multiple units are stacked vertically, to prevent inadvertent opening or breaking of the frangible seals/connectors from the direct weight and pressure of cans above a base can.

Figure 6:
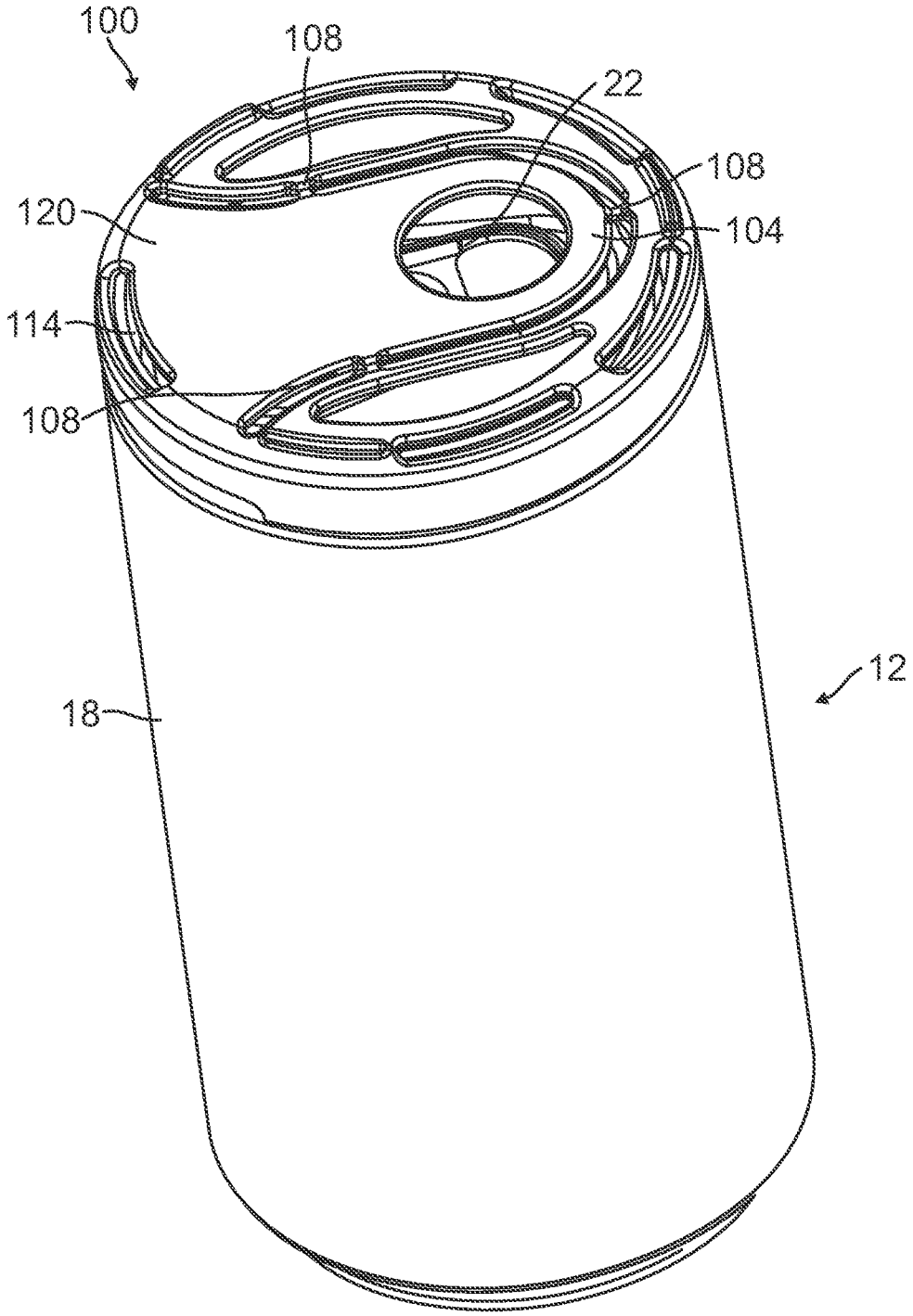
FIG. 6 shows a perspective view of a covering member applied to a can, according to an embodiment of the present invention.

FIG. 6 shows a covering member 100, as described herein, installed securely onto a can 12 to inhibit child access to the pivoting lever 22 of the can 12 to prevent unauthorized access to the contents of the can 12.

The apertures in the covering member may serve to enhance flexibility in a circumferential direction to make the covering member easily attached to a beverage can and to snugly fit on the top of the can in engagement with the rim of the can top.

The apparatuses and methods described herein may be modified or altered to comprise more aspects, concurrently steps, simultaneous steps, or other variations.

It should be understood, of course, that the foregoing relates to exemplary embodiments of the invention and that modifications may be made without departing from the spirit and scope of the invention as set forth in the following claims. Furthermore, a method herein described may be performed in one or more sequences other than the sequence presented expressly herein.

Skilled artisans may implement the described functionality in varying ways for each particular application, but such implementation decisions should not be interpreted as causing a departure from the scope of the present invention.

The word "exemplary" is used exclusively herein to mean "serving as an example, instance, or illustration." Any embodiment described herein as "exemplary" is not necessarily to be construed as preferred or advantageous over other embodiments.

In this document, relational terms such as first and second, and the like may be used solely to distinguish one entity or action from another entity or action without necessarily requiring or implying any actual such relationship or order between such entities or actions. Numerical ordinals such as "first," "second," "third," and such simply denote different singles of a plurality and do not imply any order or sequence unless specifically defined by the claim language. The sequence of the text in any of the claims does not imply that steps must be performed in a temporal or logical order according to such sequence unless it is specifically defined by the language of the claim. The steps may be interchanged in any order without departing from the scope of the invention as long as such an interchange does not contradict the claim language and is not logically nonsensical.

Furthermore, depending on the context, two elements may be connected to each other physically or in any other manner, through one or more additional elements.

While at least one exemplary embodiment has been presented in the foregoing detailed description, it should be appreciated that a vast number of variations exist. It should also be appreciated that the exemplary embodiments are only examples, and are not intended to limit the scope, applicability, or configuration of the invention in any way. Rather, the foregoing detailed description will provide those skilled in the art with a convenient road map for implementing the exemplary embodiments. It should be understood that various changes can be made in the function and arrangement of elements without departing from the scope of the invention as set forth in the appended claims and the legal equivalents thereof.

The invention claimed is:

1. A device for covering an opening formed in a first surface of a container, comprising:

a covering member having an upper surface, a lower surface, a rim portion, said lower surface contacting a rim portion of a first surface of the container;

the lower surface of the covering member having a recess for enclosing said rim portion of the first surface of the container;

wherein the container has a longitudinally extending cylindrical surface and including a rim portion extending along the periphery of the first surface of the container and a pivotal lever inside the periphery of the first surface of the container for opening the container;

a tab portion at least partially covering the pivotal lever, the tap portion comprising an opening for lifting the tab portion away from the pivotal lever;

a frangible seal securing the tab portion to another portion of the covering member;

an interior aperture formed through the covering member, the interior aperture situated between the tab portion and a guide member;

the guide member connected to the frangible seal to secure the tab portion within the covering member before lifting the tab portion away from the pivotal lever;

a lateral aperture formed from the guide member and a semi-circular stabilizing member, the lateral aperture integral with the covering member;

an outer aperture formed between the stabilizing member and the rim portion of the covering member; and a lower aperture through the tab portion.

2. The device of claim 1, wherein the device is formed as a single unitary structure.

3. The device of claim 2, wherein the single unitary structure is made from one type of material.

4. The device of claim 3, wherein the one type of material is plastic.

5. The device of claim 1, wherein the frangible seal is integral with the tab portion and the guide member.

6. The device of claim 1, wherein the device is destructively detachable from the container.

7. A combination of a device for covering an opening formed in a first surface of a can and a can for holding a beverage, comprising:

a can, including, a top with a rim portion of a first surface of the can, a cylindrical body attached to said top at said rim, an orifice formed through said top, and a pivotal lever for operation by a user to open said orifice;

a covering member having an upper surface, a lower surface, a rim-engaging portion, said lower surface contacting the rim portion extending along a periphery of a first surface of the can;

wherein the can has a longitudinally extending cylindrical surface;

the lower surface of the covering member having a recess for enclosing said rim of the first surface of the can;

wherein the can has a pivotal lever inside the periphery of the first surface of the container for opening the can;

a tab portion at least partially covering the pivotal lever, the tap portion comprising an opening for lifting the tab portion away from the pivotal lever;

a frangible seal securing the tab portion to another portion of the covering member;

an interior aperture formed through the covering member, the interior aperture situated between the tab portion and a guide member;

the guide member connected to the frangible seal to secure the tab portion within the covering member before lifting the tab portion away from the pivotal lever;

a lateral aperture formed from the guide member and a semi-circular stabilizing member, the lateral aperture integral with the covering member;

an outer aperture formed between the stabilizing member and the rim portion of the covering member; and a lower aperture through the tab portion.

8. The combination of claim 7, wherein the covering member is formed as a single unitary structure.

9. The combination of claim 8, wherein the single unitary structure is made from one type of material.

10. The combination of claim 9, wherein the one type of material is plastic.

11. The combination of claim 7, wherein the frangible seal is integral with the tab portion and the guide member.

12. The combination of claim 7, wherein the covering member is destructively detachable from the can.

13. The combination of claim 7, wherein the tab portion of the covering member comprises a finger hole.

* * * * *